US006641307B2

(12) United States Patent
Matsuda et al.

(10) Patent No.: US 6,641,307 B2
(45) Date of Patent: Nov. 4, 2003

(54) POUCH HAVING A BRANCHED CHAMBER

(75) Inventors: Naoto Matsuda, Yokohama (JP); Yasushi Hatano, Yokohama (JP); Kikuo Matsuoka, Yokohama (JP); Takashi Kuriki, Yokohama (JP)

(73) Assignee: Toyo Seikan Kaisha, Ltd., Tokyo (JP)

( * ) Notice: Subject to any disclaimer, the term of this patent is extended or adjusted under 35 U.S.C. 154(b) by 0 days.

(21) Appl. No.: 10/290,910

(22) Filed: Nov. 8, 2002

(65) Prior Publication Data

US 2003/0068102 A1 Apr. 10, 2003

Related U.S. Application Data

(62) Division of application No. 09/320,273, filed on May 28, 1999, now abandoned.

(60) Provisional application No. 60/087,304, filed on May 29, 1998, and provisional application No. 60/087,129, filed on May 29, 1998.

(51) Int. Cl.[7] ..... B65D 30/22

(52) U.S. Cl. ..... 383/38; 383/44; 383/66; 383/906

(58) Field of Search ..... 383/38, 39, 40, 383/44, 66, 906

(56) References Cited

U.S. PATENT DOCUMENTS

| | | | |
|---|---|---|---|
| 2,171,718 A | 9/1939 | Vogt | |
| 3,249,288 A | 5/1966 | Repko | |
| 3,367,380 A | 2/1968 | Dickey | |
| 4,252,238 A | 2/1981 | Spielberg et al. | |
| 4,570,820 A | 2/1986 | Murphy | |
| 4,904,093 A | 2/1990 | Woods et al. | |
| 5,059,035 A | 10/1991 | Kristrensen | |
| 5,441,345 A | 8/1995 | Garvey et al. | |
| 5,480,230 A | 1/1996 | May | |
| 5,758,473 A | 6/1998 | Patelli | |

FOREIGN PATENT DOCUMENTS

| | | | | |
|---|---|---|---|---|
| JP | 63-7645 | | 1/1988 | |
| JP | 3-240650 | | 10/1991 | |
| JP | 3-240651 | | 10/1991 | |
| JP | H5-147661 | | 6/1993 | |
| JP | 08-217090 | | 8/1996 | |
| JP | 10-203539 | * | 8/1998 | ..... 383/38 |

* cited by examiner

*Primary Examiner*—Jes F. Pascua
(74) *Attorney, Agent, or Firm*—Darby & Darby P.C

(57) ABSTRACT

At least one branched chamber extends and diverges from a side wall of a pouch body. The branched chamber has an optional pouring spout at its distal end to permit the removal of the contents of the pouch. A readily unsealable seal member is optionally included to partition the branched chamber from the pouch body, thus providing a pouch wherein two or more different materials are mixed prior to removal from the pouch. A pouch having this structure provides excellent rupture protection of the readily unsealable seal member caused from, for example, handling, shipping, or dropping of the pouch.

26 Claims, 11 Drawing Sheets

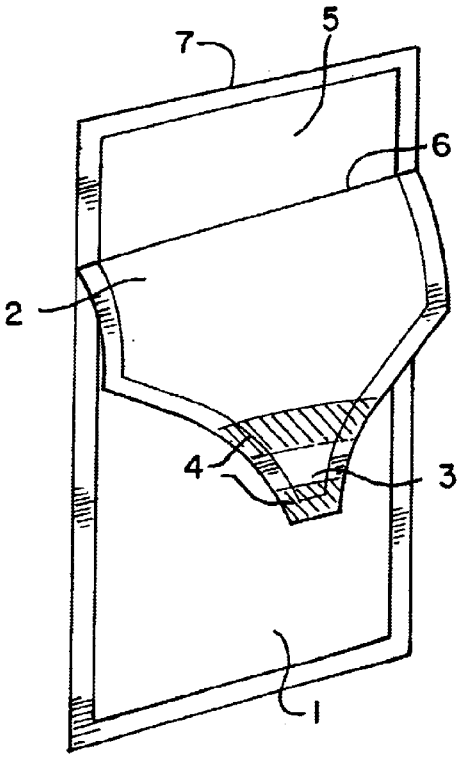
FIG. 4
FIG. 5
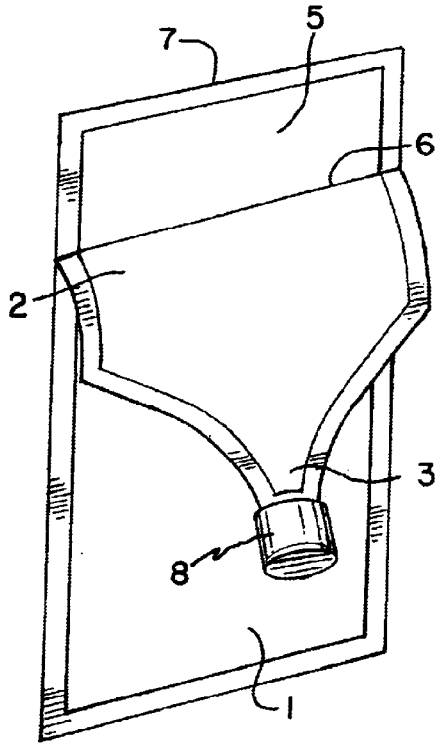
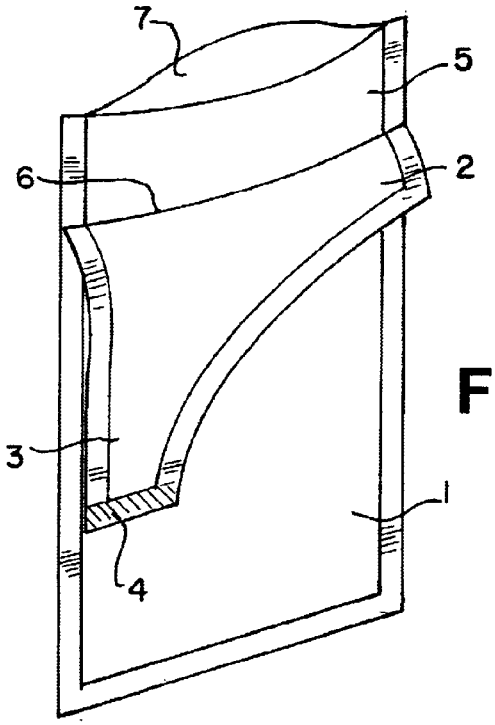
FIG. 6

FIG. 7
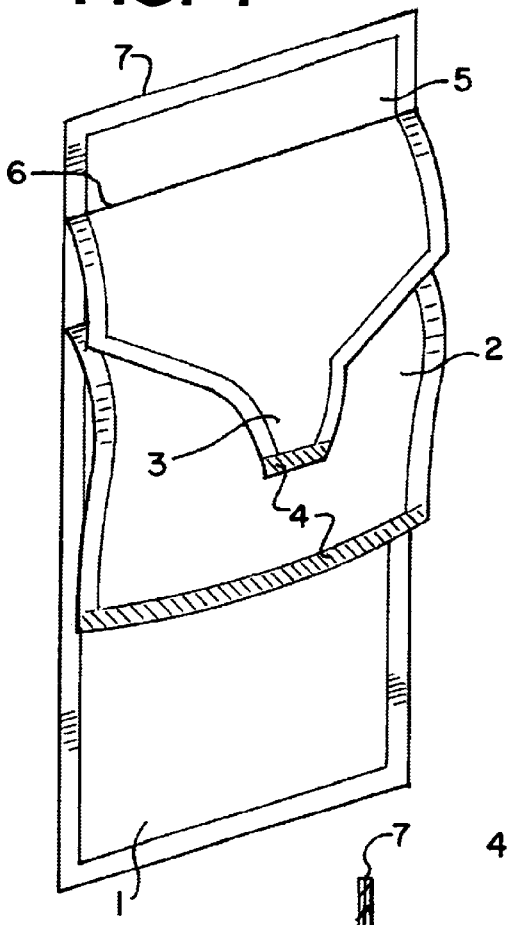
FIG. 8
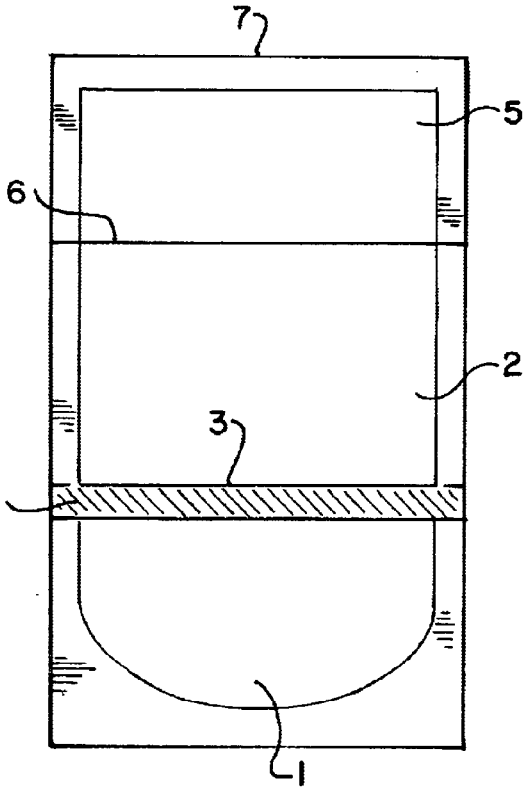
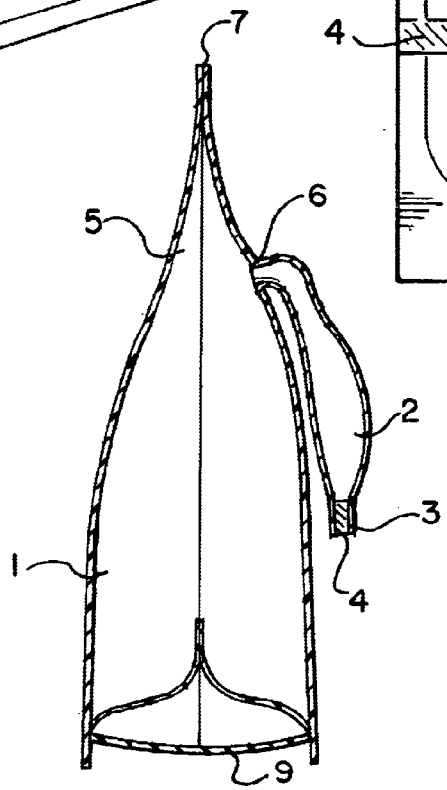
FIG. 9

POUCH HAVING A BRANCHED CHAMBER

CROSS-REFERENCE TO RELATED APPLICATION

This application is a divisional application of U.S. patent application Ser. No. 09/320,273, filed May 28, 1999 now abandoned, which claims priority to U.S. patent application Ser. No. 60/087,304, filed May 29, 1998 and U.S. patent application Ser. No. 60/087,129, filed May 29, 1998, which are all hereby incorporated by reference in their entirety.

BACKGROUND OF THE INVENTION

The present invention relates to a pouch having at least one branched chamber extending and diverging from a side wall of the pouch. More specifically, the present invention relates to a pouch having a least one branched chamber extending and diverging from the side wall of the pouch at a position lower than the top part of the pouch body. Even more specifically, the present invention relates to a multi-compartment pouch in which powder and liquid are separately stored. Additionally, the present invention relates to a pouch having a pouring outlet on at least one branched chamber extending and diverging from a side wall of the pouch.

A conventional pouch for liquid includes a pouring outlet to allow for the easy removal of the contents. Conventional pouches are known to have a variety of pouring outlets. For example, a pouch can have a separate pouring outlet, in the form of a tap, at the top of the pouch. The pouch can have an integrally molded pouring outlet. Another embodiment of conventional pouches has a pouring outlet formed by heat sealing or the like. Many pouches with 3-sided or 4-sided sealing, as well as free-standing pouches, in which the width of the bottom in spread by sealing a separate film, have used these or similar pouring outlets.

Liquid detergents, drinks, soups, or the like generally stored in the conventional pouches are filled from an unsealed portion at the top of the pouch. This portion is then sealed by heat sealing.

When used as a liquid refillable pouch, the ease of refilling becomes an issue. In all of the conventional pouring outlets described above, innovations relating to the improvement of the refilling properties have been made at the top of the pouch. With this conventional structure, the top area where the pouch is filled is at or near the location where the pouring outlet is created. As a result, innovations relating to improving the refilling properties of pouches have been severely limited by the initial filling requirements.

In conventional pouches, the pouring outlet for the refill pouch is shaped so that it is unable to be adequately joined with the bottle used to refill the pouch. Even if the refill bottle and the pouring outlet can be joined, there is a problem with easy spillage of the contents of the refill bottle, such as when the contents flow out just prior to joining. Additionally, when a tap is attached to the pouch, the tap is elevated, making the filling seal very difficult.

Conventional pouches having a pouring spout give rise to still a further problem. Since the pouring spout formed at the top portion of the pouch has a shape different from other parts of the pouch, a local stress concentration may result in the area of the pouring spout from the pouch dropping or the like. In general, there is a greater chance for the conventional pouches to burst.

Furthermore, even with conventional pouches without a refilling function, the contents are not able to be removed from the side of the pouch. When removing contents from the top of the pouch, the pouch needs to be tilted. Additionally, contents which are viscous are difficult to pour, even when the pouch is turned completely upside down. When this is done, there is the further problem of the residual contents not returning to the bottom of the pouch when the pouch is returned its upright position.

On the other hand, a two-chamber pouch has been proposed, where a weak seal or a readily unsealable seal part is formed at a center part of the pouch. Two kinds of contents, such as a medication and a solution, are separately filled. The seal part is unsealed at the time of use to mix the medication and the solution.

However, this conventional two-chamber pouch is disadvantageous in that when a local concentration of stress is generated on the weak seal or readily unsealable seal part at the center part of the pouch, the seal part can be unintentionally unsealed. Moreover, when applying a concentration of stress on the pouch to intentionally unseal the seal part, an appropriate amount of stress is required, else the pouch will rupture.

A pouch having a quantitatively pouring function has been proposed. However, this kind of pouch suffers from the problem that the quantitatively pouring function lacks accuracy.

For contents, such as medical parenteral fluids, dissolving solutions, seasonings, mixing type adhesives, or the like, where a reaction may be triggered if the contents are stored under conditions where the individual components are mixed beforehand, pouches with multiple compartments can store the appropriate components separately. When the contents are to be used, mixing of foreign substances from the outside is prevented. Furthermore, the mixing is conducted easily, without having to adjust the mixing ratio. Inasmuch, the demand for multiple compartment pouches is increasing.

In conventional multi-compartment pouches, for example, as in Japanese Laid-Open Utility Model Publication Number 60-57561, a separating barrier is formed at an area near the center of a flat pouch. This separating barrier can be formed any of the following methods: a) a method of holding down with a clamp or the like; b) a weak heat sealing method; and c) a method of heat sealing an easy peeling film.

In the conventional method of holding down with a clamp to form multiple compartments, not only is a member separate from the container body needed, but also the air-tightness of the separating barrier is brought into question.

In the conventional method of forming a weak heat seal, although the problem of air-tightness is solved, there is the problem of unintentional rupture of the weak heat seal. For example, a concentration of pressure on such a pouch may cause the contents to unintentionally mix. As a result, distribution of this type of conventional pouch is difficult. In order to alleviate the pressure to the separation barrier, the pouch can be folded into a C-shape in such a way that the separation barrier is sandwiched. Otherwise, a rigid outer packaging, such as cardboard or the like, needs to be used in order to shut out unintentional forces from the outside. Furthermore, because these conventional pouches are not self-standing, a rigid outer packaging is necessary to improve the storability of the pouches.

When the separation barrier is protected be folding the pouch, the position of the fold is limited. With a flat pouch, folding at the correct position must be conducted deliberately and is difficult and time consuming. Furthermore, the folds need to be bound by a binding strap or outer packaging. Otherwise, the fold position could shift or the pouch could open, resulting in inadequate protection of the separation barrier. Furthermore, if the pouch is folded into a C-shape, the separation barrier can easily become curved. With this curved deformation, the separation barrier can rupture more readily. On the other hand, if outer packaging is used to shut out unintentional forces from the outside, there are problems with rising costs and increased waste.

OBJECTS AND SUMMARY OF THE INVENTION

It is an object of the present invention to provide a pouch which solves the foregoing problems.

It is a further object of the present invention to provide a pouch having excellent filling and refilling properties.

It is another object of the present invention to provide a pouch which prevents the unintended flow of content contained therein.

It is still a further object of the present invention to provide a pouch with a pouring spout having excellent upright pouring properties and showing good rupture resistance against the shock of falling.

It is yet a further object of the present invention to provide a pouch having excellent self-standing and display properties.

It is still another object of the present invention to provide a pouch with at least two compartment having excellent protection of the separation barrier, with which an unintentional outside pressure will not break the seal between compartments.

It is yet another object of the present invention to provide a pouch having an excellent quantitatively pouring function.

Briefly stated, the present invention provides at least one branched chamber extending and diverging from a side wall of a pouch body. The branched chamber has an optional pouring spout at its distal end to permit the removal of the contents of the pouch. A readily unsealable seal member is optionally included to partition the branched chamber from the pouch body, thus providing a pouch wherein two or more different materials are mixed prior to removal from the pouch. A pouch having this structure provides excellent rupture protection of the readily unsealable seal member due to, for example, handling, shipping, or dropping of the pouch.

According to an embodiment of the present invention, there is provided a pouch comprising a pouch body; at least one branched chamber diverging from a side wall of the pouch body; and the at least one branched chamber diverging from the pouch body at a position other than a top part of the pouch body.

According to another embodiment of the present invention, there is provided a pouch, comprising: a pouch body; at least one branched chamber diverging from a side wall of the pouch body; the at least one branched chamber diverging from the pouch body at a position other than a top part of the pouch body; a pouring spout at a distal end of at least one of the branched chambers; a film valve at least one of the branched chambers; a first end of the film valve connecting to a first side wall of said branched chamber; a second end of the film valve connecting to a second opposite side wall of the branched chamber; and the film valve providing a quantitative cell in the branched chamber, whereby a prescribed measurement of contents are released from the branched chamber.

According to a further embodiment of the present invention, there is provided a multi-compartment pouch, comprising: a pouch body; at least one branched chamber diverging from a side wall of the pouch body; the at least one branched chamber diverging from the pouch body at a position other than a top part of the pouch body; and a pouring spout located at a distal end of at least one of the branched chambers.

More specifically, the present invention provides:

1. a pouch, preferably formed of a single-layer or multi-layer film or sheet, having at least one branched chamber extending and diverging from a side wall at a position lower than the top part of the pouch body toward the outer side;

2. the pouch as described in item 1, having an opening at the top part of the pouch body to act as a port for filling the content of the pouch, and an opening at the distal end of the branched chamber to act as a pouring spout;

3. the pouch as described in item 1 or 2, wherein the branched chamber is fixed by folding it along the side wall of the pouch body;

4. the pouch as described in items 1 to 3, having a pressure absorbing space between the top part of the pouch body and the diverging part of the pouch body;

5. the pouch as described in items 1 to 4, having a readily unsealable seal part in the branched chamber, whereby the branched chamber is separated from the rest of the pouch;

6. the pouch as described in item 5, wherein the readily unsealable seal part is in the pouring spout at the distal end of the branched chamber;

7. the pouch as described in item 5, wherein the readily unsealable seal part is formed in an area below the diverging part;

8. the pouch as described in items 5 to 7, wherein the readily unsealable seal part is a readily unsealable seal member;

9. the pouch as described in item 8, wherein the readily unsealable seal member is a resin different from the resin forming the inner surface of the branched chamber;

10. the pouch as described in item 8, wherein the readily unsealable seal member has one surface made of a resin capable to tight sealing with the inner surface resin of the branched chamber, and another surface made of a resin capable of readily peeling from the inner surface resin of the branched chamber;

11. the pouch as described in item 8, wherein the readily unsealable seal member is a mixed resin of the same kind of resin as the inner surface resin of the branched chamber and a resin incompatible with the inner surface resin of the branched chamber;

12. the pouch as described in item 8, wherein the readily unsealable seal member has at least two layers consisting of a readily peelable seal layer and a tight seal layer, with the readily peelable seal layer formed of a heat seal resin different from the inner surface resin of the branched chamber, or a mixed resin made from the said kind of resin and a resin incompatible with the resin of the branched chamber;

13. the pouch as described in item 12, wherein the readily peelable seal layer consists of a cohesive failure layer and a heat seal thin layer;

14. the pouch as described in items 1 to 5, having a film valve within the branched chamber; and 15. the pouch as described in item 14, wherein one end of the film valve is connected to one side wall of the branched chamber, and another end of the film valve is connected to another side wall of the branched chamber.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 4 shows a fourth embodiment of the pouch of the present invention.

FIG. 5 shows a fifth embodiment of the pouch of the present invention.

FIG. 6 shows a sixth embodiment of the pouch of the present invention.

FIG. 7 shows a seventh embodiment of the pouch of the present invention.

FIG. 8 shows an eighth embodiment of the pouch of the present invention.

FIG. 9 shows a ninth embodiment of the pouch of the present invention.

DETAILED DESCRIPTION OF THE INVENTION

Figure 1:
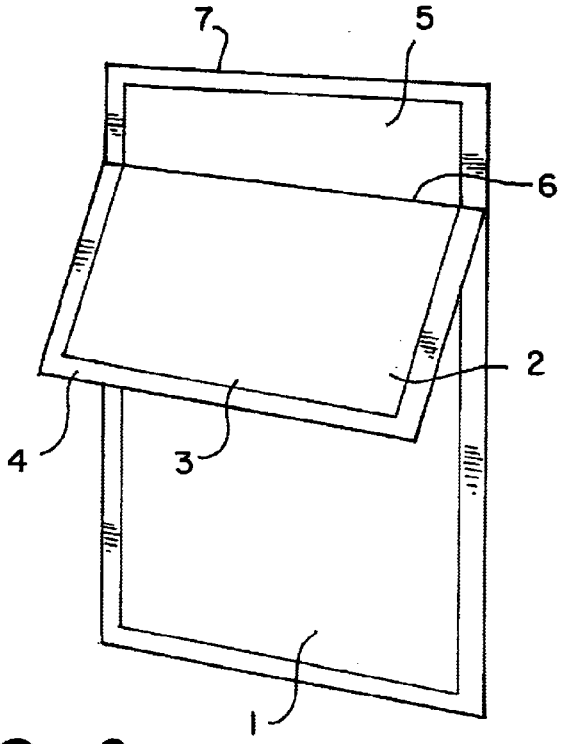
FIG. 1 shows a first embodiment of the pouch of the present invention.

The pouch of the present invention has at least one branched chamber extending and diverging from a side wall at a position lower than a top part of the pouch body. The branched chamber allows the content filling part and the content pouring part to be formed at separate positions, resulting in a pouch having a high filling property and excellent pouring properties. In addition, at least one branched chamber may act as a pouring port, subsidiary chamber, or quantitative chamber.

Branched chambers formed from the side wall of the pouch body are different from those from partitioning a pouch body to divide the pouch body into compartments. With the design of the branched chambers of the present invention, the branched chambers fold to lie along the side wall of the pouch due to pouch body deformation when the pouch body is filled with its contents. As a result, an impact force generated in the pouch body, due to a fall of the like, is buffered or is disrupted by the folds formed by the branched chambers. The rupture force which acts on the compartments is thereby effectively reduced.

An optional readily unsealable seal member partitions the branched chambers from the pouch body. The readily unsealable seal member is preferably positioned slightly closer towards the branched chamber side rather than towards the fold where the branched chamber attaches to the pouch body. When the pouch is stored with the branched chamber laid along the pouch body, the unintentional unsealing of the readily unsealable seal member is substantially prevented. There is no adequate theory to explain the prevention of unintentionally unsealing the readily unsealable seal member when the readily unsealable seal member is positioned away from the fold, toward the branched chamber as described above. This phenomenon, however, is repeatable and reproducible.

While not being limited to any one particular theory, one explanation of the above phenomenon is proposed. In contrast to when a conventional flat pouch which is partitioned and folded, in the case of the branched chamber described above, the branching part is joined and secured to the pouch body at both cross-wise edges. As a result, even if pressure is applied, the folding part does not shift. In the case of the conventional flat pouch, when pressure is applied to the pouch, a tensile force which attempts to stretch the partition along the side wall is applied to the outside of the folded partition. Meanwhile, on the interior, there is a compressive force which tries to crush the partition along the side wall. The partition ruptures due to these two opposing forces. However, in the embodiment of the pouch of the present invention having a readily unsealable seal member positioned away from the fold, toward the branched chamber, the partition is not located at the folding part. The tensile and compressive force applied to the folding part is applied to the side wall of the sheet, and not to the partition. When the contents, which have passed through the folded part, apply a pressure to the partition, the folded part tries to rise. The branched chamber stands up or tries to stand up. As a result of the work expended by unfolding the folded part, and standing up the branched chamber, the unsealing energy which is applied to the readily unsealable seal member is minimal. Thus, the unsealing of the partition is prevented.

In addition to being a readily unsealable seal member, the partition can also be a tight heat seal. In this embodiment of the invention, the pouch body and the branching compartment can be used as two completely separate pouches. In this case, the contents are individually removed from the pouch parts which form individual compartments by cutting open an edge or by cutting near the branching area.

If the partition is a readily unsealable seal member, or a compression easy open seal, substances which can not be mixed beforehand are stored separately. At the time of use, the contents are mixed and used by applying outside pressure and peeling the seal. In the pouch of the present invention, binding straps or outside packaging is not needed. The fold is accurately formed at the correct position. Furthermore, the fold position does not readily shift, and the folding does not readily open. The result is a multi-compartment pouch which is excellent for protecting the separation barrier.

An optional pouring outlet is included in the branched chamber to facilitate the removal of the contents of the pouch. The end of the branched chamber can be made into a tapered pouring outlet, preferably having a length of 5 mm–300 mm. This tapered end permits insertion of the pouring outlet into a receiving container, preventing spillage. A tapered pouring outlet is particularly preferred when the contents of the pouch are liquid. The tapered pouring outlet can be tapered towards the center of the end of the branched chamber, or tapered towards one side of the end of the branched chamber. The tapered pouring outlet can be formed by heat sealing the end of the branched chamber. The heat sealed part is then cut and removed to allow for the pouring of the contents through the branched chamber.

The optional pouring outlet may also be formed from the entire width of the branched chamber when there is no taper present. This embodiment is particularly preferred when the contents are transferred into a receiving container having a large opening.

The pouring outlet is preferably sealed until removal of the contents is desired. The pouring outlet may be sealed by any known means, preferably by a tight seal, a compression easy open seal, a rubber stopper, a screw cap, or a crown cap.

In addition to having a pouring outlet formed directly on the branched chamber, a separately molded tap can be joined to the branched chamber to form a pouring outlet. The tap is optionally tapered depending on the size of the opening of the receiving container. The tap is optionally sealed by a cap or stopper.

The partition between the pouch body and the branched chamber and the compression easy open seal (readily unsealable seal member) of the pouring outlet take advantage of the characteristic that the heat adhesive strength between a synthetic resin sheet and a sheet of a different type is small. These seals are formed by taking a synthetic resin sheet that is of a type which is different from the innermost layer of the base material sheet and placing this different sheet between the base material sheets of the partition or the pouring outlet. This area is then heat scaled.

A blend layer, in which a resin that is incompatible with the innermost layer of the base material sheet is added, also has a small heat adhesive strength with the base material sheet. Therefore, a blend layer, in the form of a sheet of a film, is placed between the base material sheets and heat sealed. When this kind of seal layer is placed between sheets of the base material, the adhesive force is weal because a resin of a different quality is added. As a result, if a sufficient outside pressure is applied, the contact surface between the seal layer and the innermost layer of the base material sheet peels and unseals. Furthermore, if the cohesive force of the seal layer itself is smaller than the adhesive force of the base material with the seal layer, there is inner rupture of the seal layer, resulting in unsealing of the two sections.

If there are two or more branched chambers, the seal strength of each of the partitions for each branched chamber can be selected to require differing sufficient outside pressures to break the seal. Thus, independent compartments that can be selectively opened can coexist in the same pouch.

The branched chamber preferably has a length from about 10 mm to about 500 mm. If the length of the branched chamber is less than 10 mm, the branched chamber is difficult to form. If the length of the branched chamber exceeds 500 mm, the branched chamber cannot be easily disposed by folding it along the side wall of the pouch.

The pouch of the present invention can be formed from a number of materials to make a single-layer or multi-layer film or sheet having flexibility. Examples of preferred materials to make the pouch include the following: low-density polyethylene, middle-density polyethylene, high-density polyethylene, linear low-density polyethylene, polypropylene, polybutene-based resin, polymethylpentene-based resin, ionomer resin, ethylene-propylene copolymer, ethylene-vinyl acetate copolymer, ethylene-vinyl acetate copolymer saponified product, ethylene-acrylic acid copolymer, ethylene-ethyl acrylate copolymer, polyacrylic resin, polyacrylonitrile-based resin, polyester-based resin (e.g., polyethylene terephthalate, polyethylene naphthalate), polyamide-based resin, polystyrene-based resin, polyvinyl chloride-based resin, polyvinylidene chloride-based resin, polycarbonate-based resin, fluorine-based resin, and phenolic resin.

When a gas barrier property is required, a polyvinylidene chloride layer, an ethylene-vinyl acetate copolymer saponification product layer, a stretched polyamide-based resin layer, an aluminum deposited layer, a vacuum evaporation layer of metal oxide such as silicon oxide, an aluminum foil, a steel foil, or the like, may be introduced into the multi-stacked layers. In addition, a foam or such a synthetic resin may be introduced into the multi-stacked layers so as to impart rigidity, heat insulating properties, and the like. Furthermore, a layer comprising such a resin having filled into an inorganic material such as titanium oxide, calcium carbonate, or carbon may be introduced. Moreover, a paper or corrugated board layer may also be introduced.

These materials are formed into a single-layer or multi-layer film or sheet depending on the intended use of the pouch of the present invention. The film or sheet is preferably made by a casting method, a calendering method, a melt extrusion or melt coextrusion method such as a T-die method or inflation method, or a dry lamination method. Furthermore, the film or sheet can be non-orientated (unstretched) or stretched uniaxially or biaxially.

The thickness of the single-layer or multi-layer film or sheet varies depending on the intended use of the pouch, with the requirement that the pouch remain flexible and compressible.

The pouch of the present invention has a heat seal part. Accordingly, when a multi-layer film or sheet is used, it is preferred to use a resin having a heat sealability for one surface and a resin having heat unsealability for another surface where a diverging part (branched chamber) is provided. With respect to the readily unsealable seal material used in the readily unsealable seal part, base material films or sheets of the branched chamber are heat sealed after interposing therebetween a synthetic resin film or sheet different therefrom. Alternatively, base material films or sheets of the branched chamber are heat sealed after interposing therebetween a layer comprising a blend of an inner surface resin of the base material film or sheet and a synthetic resin incompatible therewith. These methods makes use of the low heat sealability property of two differing synthetic resins.

The pouch of the present invention can be produced by various methods. One example of a pouch having a branched chamber made from a single-layer film is described. For convenience, the side where the branched chamber is formed is referred to as the front side. The opposite side is referred to as the back side.

A front side film is slackened longitudinally and placed on top of a back sheet. Without heat sealing the slackened part with the wall of what will become the pouch body, both cross-directional edges of the slackened part is heat sealed, forming a small compartment. Excluding the top part, the front sheet and the back sheet are sealed on the remaining three sides, and the pouch body is formed having a branching small compartment.

A pouch is formed using a laminated sheet by folding a single laminated sheet so that a surface that is not heat sealable is on the inside, and a surface that is heat sealable is on the outside. Meanwhile, the front sheet and back sheet are placed on top of each other so that the heat sealable surfaces face each other. Between these sheets, the previously described folded sheet is inserted. The open end of the folded sheet is matched to the edge of both the front and back sheets. Excluding the top of these sheets which are placed on top of each other, the remaining three sides are sealed. Because the inner side of the folded sheet is not heat sealed, a branching small compartment is formed in the pouch.

Applications for multi-compartment pouches of the present invention wherein the compartment is partitioned with a compression easy open seal include a two agent mixture type parenteral fluid or injection drug for medical use. Liquid can be combined with liquid, or liquid can be combined with powder or solid. Each agent is filled into separate compartments. At the time of use, the seal is compressed and both agents are mixed together and used. Examples of these include the combination of amino acid solution and sugar or electrolyte solution or powder, and the combination of a dissolving solution, such as a saline solution, and an antibiotic, or the like.

Additionally, the multi-compartment pouch of the present invention is suitable for two or more agent mixing type adhesives or for sealing agents. For example, the pouch of the present invention is useful for a hardening agent combination of an epoxy resin and a polyamide or the like.

The multi-compartment pouch of the present invention is further suitable for substances in which a reaction is triggered when they are mixed. Such substances include solid sparkling carbonated drink and dissolving solution. The pouch can is also useful for combination of substances which can not be mixed beforehand.

On the other hand, if the partition is a tight heat seal or the like, the substances stored in the compartment are substances which do not have to be mixed. These pouches are often used for substances which are used independently. Of course, the substance can be removed from the compartment and then added to the pouch body if desired.

When the pouch has additional compartments, even more substances can be mixed. The seals can be tight seals or easy open seals. The seals can be adapted as necessary depending on the contents of each compartment.

Furthermore, depending on the desired application, a hanging member can be added to suspend or hang the pouch. Holes can be included in the top of the pouch to also suspend or hang the pouch from a hook.

The pouch of the present invention is described in greater detail below by referring to the specific Embodiments and Examples.

Embodiment 1

Referring to FIG. 1, a four side-sealed flat pouch has a branched chamber 2 extending and diverging from a side wall of pouch body 1. Branched chamber 2 is located at a position lower than a top part 7 of pouch body 1 toward an outer side. Content is filled through top part 7, which is heat sealed after filling.

A pouring spout 3 is located at a distal end of branched chamber 2. A seal part 4, sealing pouring spout 3, is a tight seal part. Pouring port 3 has substantially the same width as the width of pouch body 1. Depending on desired use, seal part 4, sealing pouring spout 3, can be a readily unsealable seal part.

A pressure absorbing space 5 is between a diverging part 6 and top part 7 of pouch body 1. Pressure absorbing space 5 absorbs movement of the content within pouch body 1 when a falling shock or an external shock during distribution is imposed on the pouch after the filling of the contents. Pressure absorbing space 5 further prevents the content from flowing into branched chamber 2, thereby preventing the unsealing of pouring port 3.

Embodiment 2

Figure 2:
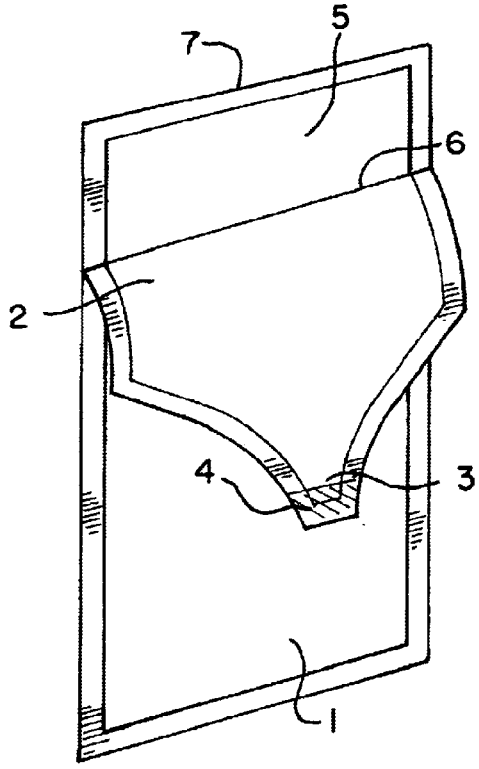
FIG. 2 shows a second embodiment of the pouch of the present invention.

Referring to FIG. 2, the pouch of Embodiment 1 is modified by tapering pouring spout 3 of branched chamber 2. Seal part 4 is at the distal end of pouring spout 3. A pouch having this construction has excellent refilling properties.

Embodiment 3

Figure 3:
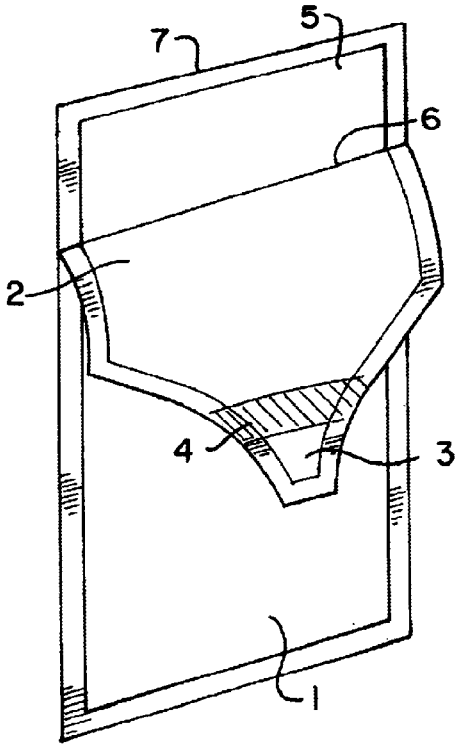
FIG. 3 shows a third embodiment of the pouch of the present invention.

Referring to FIG. 3, the pouch of Embodiment 2 is modified by forming seal part 4 more proximal to pouch body 1 rather than at the distal end of pouring spout 3. A pouch having this construction has seal part 4 protected by the distal end of pouring spout 3. This prevents the unintentional damage or unsealing, for example, during handling or distribution.

Embodiment 4

Referring to FIG. 4, the pouch of Embodiment 3 is modified by forming two seal parts 4, one at the distal end of branched chamber 2, and the second at a location proximal to pouch body 1. Similarly to Embodiment 3, seal part 4 is protected from unintentional damage or unsealing during, for example, handling or distribution.

Embodiment 5

Referring to FIG. 5, a plug body 8 seals the distal end of tapered branched chamber 2. Plug body 8 is separately produced and later joined to pouring spout 3. Plug body 8 is preferably a screw cap or the like. A pouch of this construction has the advantage of being easily resealed.

Embodiment 6

Referring to FIG. 6, tapered pouring spout 3 of branched chamber 2 is formed substantially at one edge part in the cross-sectional direction (to the left and right in FIG. 6) as opposed to generally near the center as in Embodiments 2–5.

By having this construction, pouring spout 3 is easily inserted, for example, into a receiving container having a filling port at its edge.

Embodiment 7

Referring to FIG. 7, a flat pouch has two branched chambers 2 which diverge from pouch body 1 at a diverging part 6. In the first branched chamber 2, pouring spout 3 has generally the same width as the width of pouch body 1. In the second branched chamber 2, pouring spout 3 is tapered. Each pouring spout 3 is sealed at their respective seal parts 4. Seal parts 4 are either a readily unsealable seal or a tight seal. Each seal part 4 are either of the same or different seal strengths, depending on the intended use of the pouch.

When seal part 4 of one pouring spout 3 is a readily unsealable seal, and seal part 4 of the other pouring spout 3 is a tighter seal, pouring spout 3 having seal part 4 which is readily unsealable is selectively unsealed by applying pressure to the pouch. Thus, selective unsealing of multiple compartments is achieved.

Embodiment 8

Referring to FIGS. 8 and 9, a self-standing pouch has branched chamber 2 extending and diverging from a side wall of pouch body 1 at a location lower than top part 7. In this embodiment of the present invention, a gore part 9 is at the bottom of pouch body 1 to impart the pouch's self-supporting property.

Embodiment 9

Figure 10:
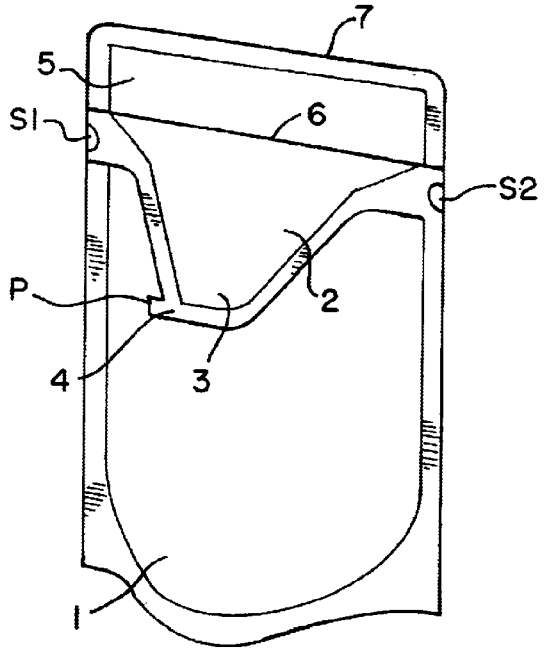
FIG. 10 shows a cross-sectional view of the pouch of FIG. 9.

Referring to FIG. 10, a pouch, preferably a self-standing pouch, has a tapered pouring spout 3 with a tab P at its distal end. Seal part 4, at the distal end of pouring spout 3, is a tight seal. The distal end of pouring spout 3 is formed such that the tearing of tab P results in the removal of seal part 4, thus opening branched chamber 2. Preferably, in the vicinity of seal part 4, the pouch is laser or machine processed to allow for the easy removal of seal part 4 by tearing along tab P.

In the pouch of this Embodiment of the present invention, branched chamber 2 is folded along the side wall of pouch body 1. The upper two side parts of branched chamber 2 are fixed by spot seal parts, S1 and S2. A pouch of this construction prevents the contents from unintentionally flowing into branched chamber 2 from pouch body 1 when, for example, the pouch is dropped.

Embodiment 10

Figure 11:
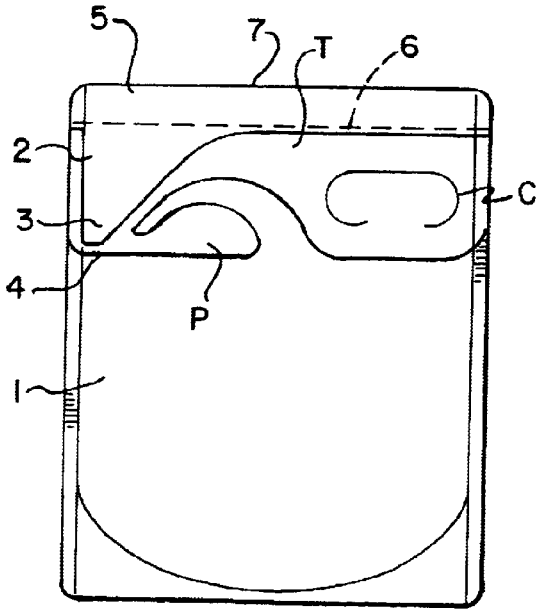
FIG. 11 shows a tenth embodiment of the pouch of the present invention.

Referring to FIG. 11, a pouch, preferably a self-standing pouch, has pouring spout 3 formed generally at one cross-sectional (to the left and right in the Figure) edge of branched chamber 2. A heat seal surface T is on a side surface of branched chamber 2. One part of heat seal surface T has tab P connecting with seal part 4 at the distal end of pouring spout 3. In another part of heat seal surface T, a slit C is formed to aid in carrying the pouch.

A pouch having this construction is effectively used as a large-size pouch. Such pouches have excellent pouring, refilling, unsealability, and handling properties.

In Embodiments 1–10 described above, the content is preferably poured out from the pouch by raising branched chamber 2 from pouch body 1, turning the pouch upside down, thus directing pouring spout 3 downward, and squeezing pouch body 1 to discharge the contents.

If seal part 4 is a readily peelable seal part, pouring spout 3 is unsealed by the pressure exerted on the pouch body when the pouch is upside down. On the other hand, if seal part 4 is a tight seal part, pouring spout 3 is unsealed by tearing off the vicinity of pouring spout 3, containing seal part 4, before turning the pouch upside down.

Embodiment 11

Figure 12:
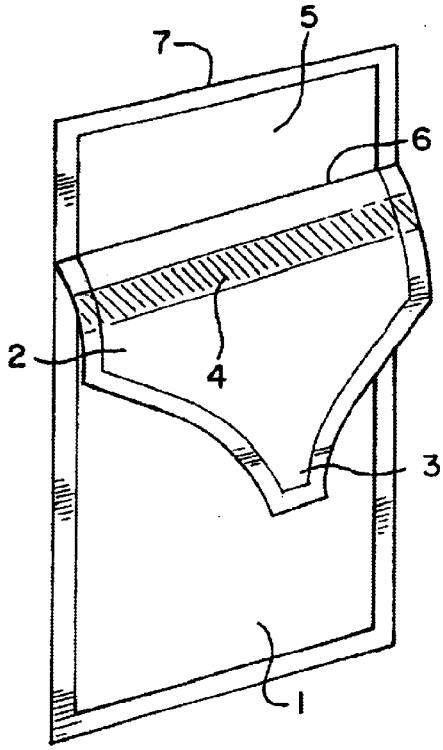
FIG. 12 shows a eleventh embodiment of the pouch of the present invention.

Referring to FIG. 12, a flat pouch has a tapered pouring spout 3 at the distal end of branched chamber 2. Seal part 4 is formed in branched chamber 2 in the area below diverging part 6. Seal part 4, located closer to pouch body 1 than in Embodiments 3 and 4, is a readily unsealable seal part. Pouring spout 3 is sealed by an appropriate method, such as heat sealing, an adhesive, or a plug body.

Pressure absorbing space 5, between diverging part 6 and top part 7 of pouch body 1, absorbs the movement of content within pouch body 1 when an unintentional pressure, such as during handling or if the pouch is dropped, is applied to pouch body 1. Pressure absorbing space 5 prevents seal part 4 of branched chamber 2 from unintentionally peeling off before use.

A pouch having this construction is well adapted for use in containing two kinds of contents which are to be mixed prior to use. For example, a medication and a solution are separately filled into pouch body 1 and branched chamber 2. Prior to use, the contents are easily mixed and poured.

Embodiment 12

Figure 13:
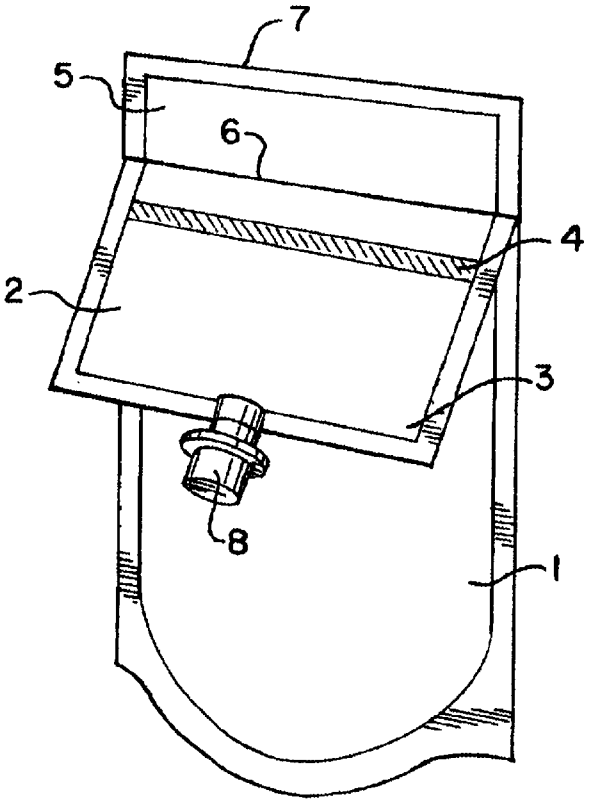
FIG. 13 shows a twelfth embodiment of the pouch of the present invention.

Referring to FIG. 13, a self-standing pouch has a plug body 8 joined to pouring spout 3 at the distal end of branched chamber 2. Plug body 8 is preferably a screw cap or the like, permitting resealing of the pouch. As in Embodiment 11, seal part 4 is formed in branched chamber 2 in the area below diverging part 6. Seal part 4, located closer to pouch body 1 than in Embodiments 3 and 4, is a readily unsealable seal part.

Pressure absorbing space 5, between diverging part 6 and top part 7 of pouch body 1, absorbs the movement of content within pouch body 1 when an unintentional pressure, such as during handling or if the pouch is dropped, is applied to pouch body 1. Pressure absorbing space 5 prevents seal part 4 of branched chamber 2 from unintentionally peeling off before use.

In the pouches of Embodiments 11 and 12, the pouch is preferably operated by expanding branched chamber 2 from pouch body 1 until pouch body 1 and branched chamber 2 lie horizontally. Pouch body 1 is pressurized to peel off seal part 4 of branched chamber 2, thereby mixing the contents of pouch body 1 and branched chamber 2. Pouring spout 3 is appropriately unsealed, and the mixed contents are poured.

Figure 14:
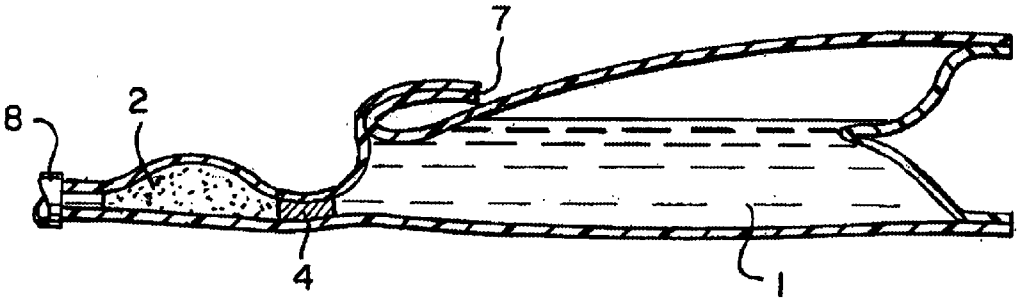
FIG. 14 is a cross-sectional view of the pouch of FIG. 13.
Figure 15:
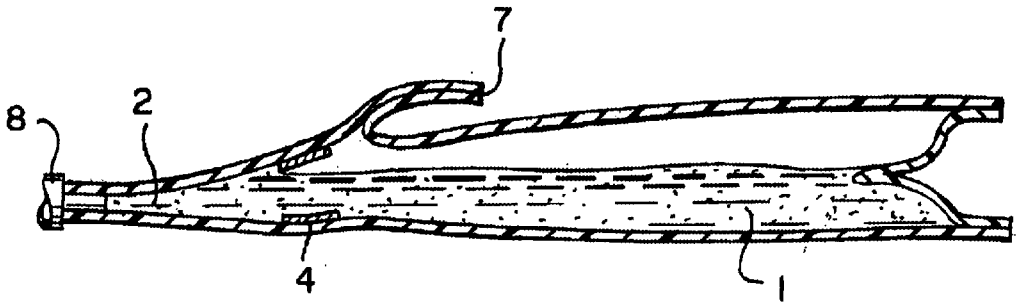
FIG. 15 is a cross-sectional view of the pouch of FIG. 13 with the readily unsealable seal member ruptured.

Referring to FIGS. 14 and 15, a mode of operation of the pouch of Embodiment 12 is described. Pouch body 1 and branched chamber 2 are filled. The pouch is invented and extended such that branched chamber 2 becomes linear with pouch body 1. Pouch body 1 is pressed to unseal seal part 3, mixing the contents of pouch body 1 and branched chamber 2. Plug body 8 is then removed to allow for the pouring of the mixed contents from the pouch.

Embodiment 13

Figure 16:
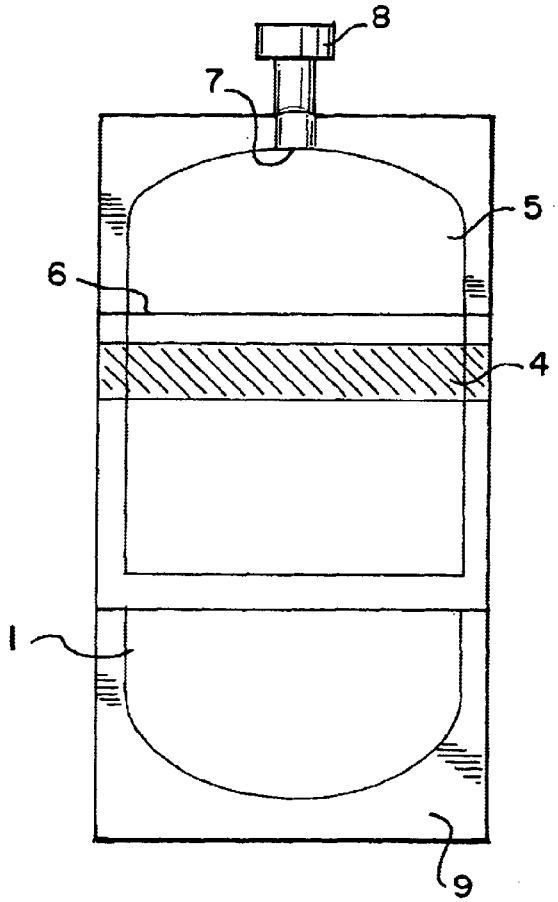
FIG. 16 shows a thirteenth embodiment of the pouch of the present invention.
Figure 17:
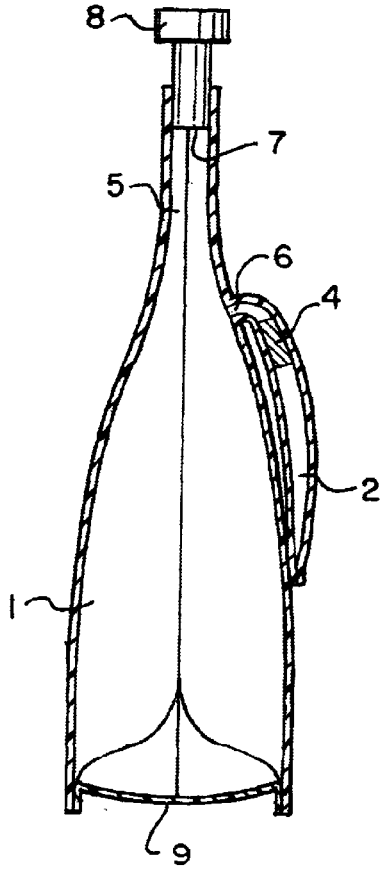
FIG. 17 is a cross-sectional view of the pouch of FIG. 16.

Referring to FIGS. 16 and 17, a self-standing pouch optionally includes plug body 8 at top part 7 of pouch body 1. Seal 4 is preferably a readily unsealable seal member. After the contents of pouch body 1 and branched chamber 2 are mixed, the contents are removed through plug body 8. Branched chamber 2 optionally includes pouring spout 3 (not shown in the figures) as an additional pouring or refilling passageway.

Embodiment 14

Figure 18:
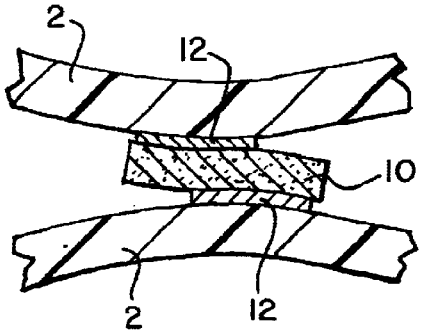
FIG. 18 is a cross-sectional view of a readily unsealable seal.

Referring to FIG. 18, a first embodiment of seal part 4 is a readily unsealable seal part. A first surface of a readily unsealable seal member 10 has a tight seal part 12. A second opposite surface of a readily unsealable seal member 10 has a readily peelable seal part 11. Tight seal part 12 and readily peelable seal member 11 are offset on opposite sides of readily unsealable seal member 10 such that tight seal part 12 is preferably located closer to the pouch body, and readily peelable seal member 11 is preferably located closer to the pouring spout.

A readily unsealable seal member 10 having this construction prevents seal part 4 from unintentionally unsealing due to an external pressure being applied to the branched chamber. Unsealable seal member 10 is preferably a mixed resin formed from mixing a resin of the same kind as the inner surface of the pouch with a resin incompatible with the resin of the inner surface of the pouch.

Embodiment 15

Figure 19:
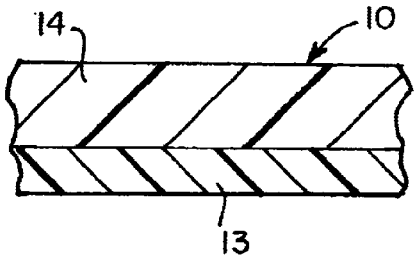
FIG. 19 is a cross-sectional view of a two-layer film used as the readily unsealable seal member of FIG. 18.

Referring to FIG. 19, a second embodiment of seal part 4 is a two-layer film having a readily peelable seal layer 13 and a tight seal layer 14 combined to form readily unsealable seal member 10. Readily peelable seal layer 13 is either a heat seal resin different from the inner surface resin of the pouch, or a heat seal resin made from a blend of the same kind of resin as the inner surface resin of the pouch and a resin incompatible therewith. Readily peelable seal layer 13 optionally contains an inorganic material such as calcium carbonate or titanium oxide. Furthermore, readily peelable seal layer 13 may be rendered porous by a foaming agent, thus improving its peelablilty.

Embodiment 16

Figure 20:
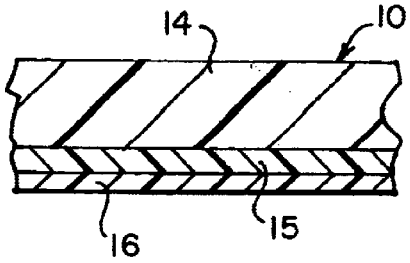
FIG. 20 is a cross-sectional view of another embodiment of the readily unsealable seal member of FIG. 18.

Referring to FIG. 20, a third embodiment of seal part 4 is a three-layer film having tight seal layer 14, a cohesive failure layer 15, and a heat seal thin layer 16 combined to form readily unsealable seal member 10. In this embodiment of seal part 4, when a peeling force acts to rupture heat seal thin layer 16, the peeling takes place as an interlayer peeling. Cohesive failure layer 15 acts as an intermediate layer to form a readily unsealable seal part.

Embodiment 17

Figure 21:
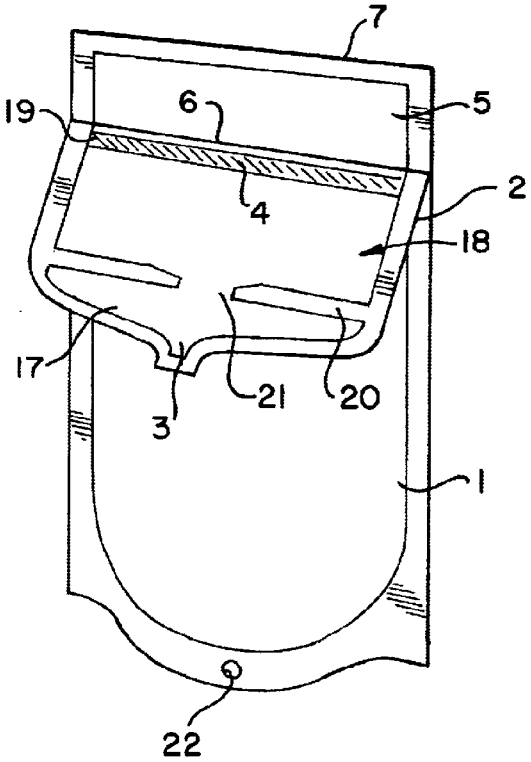
FIG. 21 shows a fourteenth embodiment of the pouch of the present invention.
Figure 22:
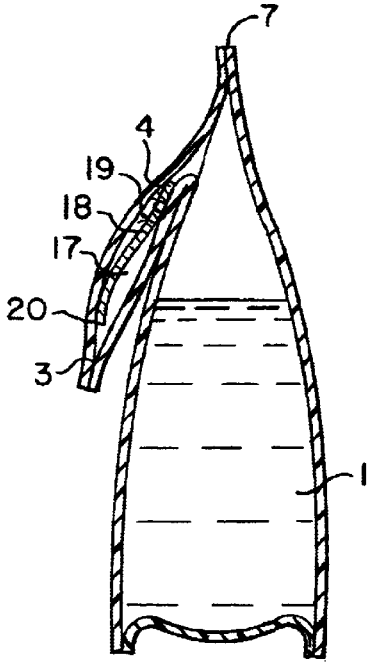
FIG. 22 is a cross-sectional view of the pouch of FIG. 21.
Figure 23:
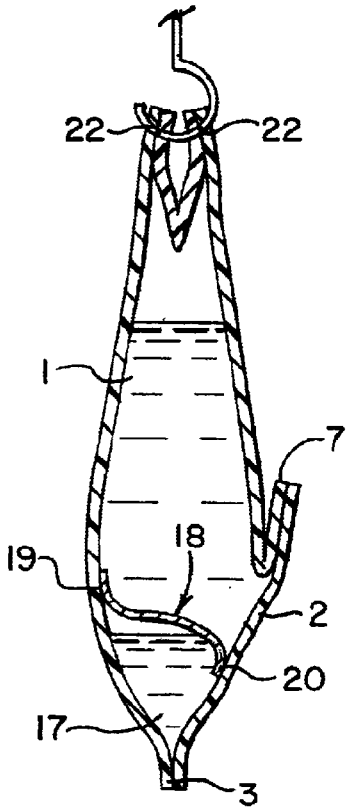
FIG. 23 is a schematic cross-sectional view of the pouch of FIG. 21 in a state of use.

Referring to FIGS. 21–23, a film valve 18 is provided with branched chamber 2 to form a quantitative cell 17 within branched chamber 2. Branched chamber 2 extends from the side wall at a position lower than top part 7 of pouch body 1. An upper edge 19 and a lower edge 20 of film valve 18 are heat sealed or bonded to the side wall member within branched chamber 2. A non-sealed part 21, at substantially the center of lower edge 20, communicates pouch body 1 and quantitative cell 17 of branched chamber 2.

An anchoring hole 22, punched at the bottom of the pouch, is anchored to an anchoring tool, such as a hook, to turn the pouch upside down. The contents flow into branched chamber 2, pass through non-sealed part 21 in lower edge 20 of film valve 18, and fill quantitative cell 17. The distal end of pouring spout 3 is then unsealed and quantitative cell 17 is pressed. The contents of quantitative cell 17 are released through the unsealed pouring spout 3.

Film valve 18 prevents the contents of quantitative cell 17 to escape back onto pouch body 1. Thus, stable pouring and an exact quantitative supply is ensured.

When the pressing of quantitative cell 17 is stopped, the contents are refilled from pouch body 1 through film valve 18. The operation is sequentially repeated as necessary.

An optional seal part 4 is a readily unsealable seal located between diverging part 6 and upper edge 19 of film valve 18. Seal part 4 prevents the unnecessary flow of contents into branched chamber 2 from pouch body 1 prior to use.

Figure 24A:
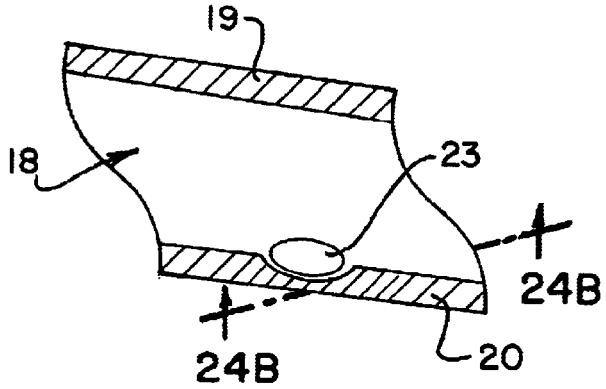
FIG. 24(A) shows a film valve for use in the pouch of the present invention.
Figure 24B:
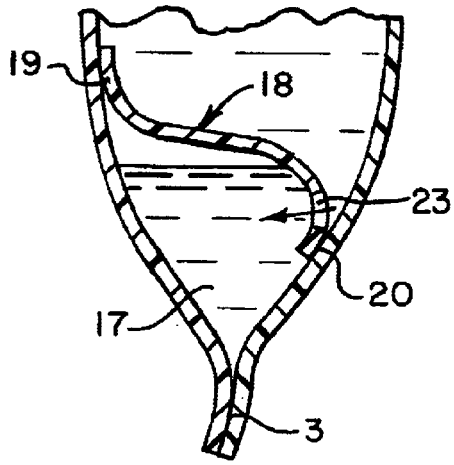
FIG. 24(B) shows the film valve of FIG. 24A installed in a pouch.

Referring to FIGS. 24(A) and 24(B), a first embodiment of film valve 18 has upper edge 19 and lower edge 20 entirely heat sealed to one side wall member and another side wall member, respectively, of branched chamber 2. A hole 23, for communicating pouch body 1 and quantitative cell 17, is provided in a lower edge of film valve 18.

Figure 25A:
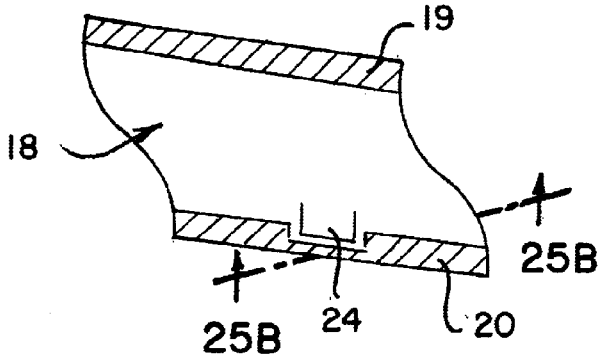
FIG. 25(A) shows a second embodiment of the film valve for use in the pouch of the present invention.
Figure 25B:
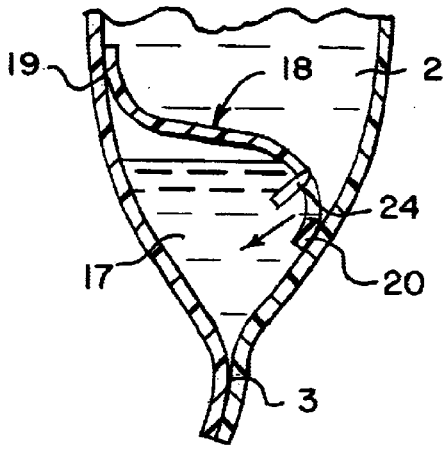
FIG. 25(B) shows the film valve of FIG. 25A installed in a pouch.

Referring to FIGS. 25(A) and 25(B), a second embodiment of film valve 18 has upper edge 19 and lower edge 20 entirely heat sealed to one side wall member and another side wall member, respectively, of branched chamber 2. A slit 24, for communicating pouch body 1 and quantitative cell 17, is provided in a lower edge of film valve 18.

Figure 26A:
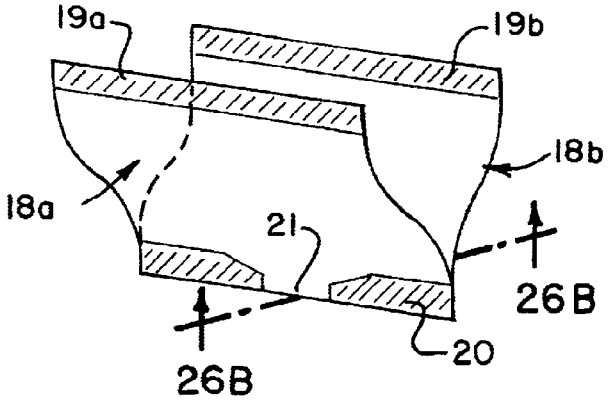
FIG. 26(A) shows a third embodiment of the film valve for use in the pouch of the present invention.
Figure 26B:
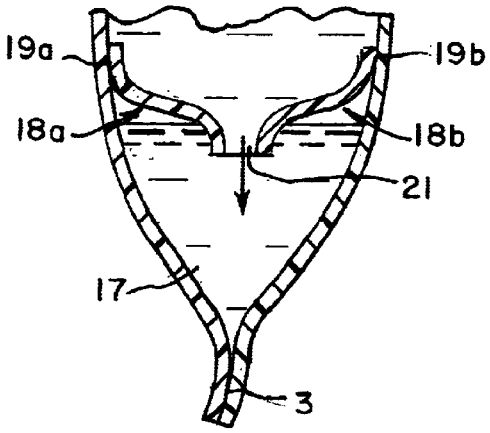
FIG. 26(B) shows the film valve of FIG. 26A installed in a pouch.

Referring to FIGS. 26(A) and 26(B), a third embodiment of film valve 18 has one end of each of two sheets 18*a* and 18*b* heat sealed together at lower edge 20. The other end of each of two sheets 18*a* and 18*b* comprise upper edges 19*a* and 19*b*. Upper edges 19*a* and 19*b* are heat sealed to opposite sides of branched chamber 2 to form a generally V-shaped cross-section (see FIG. 26(B)). Non-sealed part 21 communicate pouch body 1 and quantitative cell 17 of branched chamber 2.

Figure 27B:
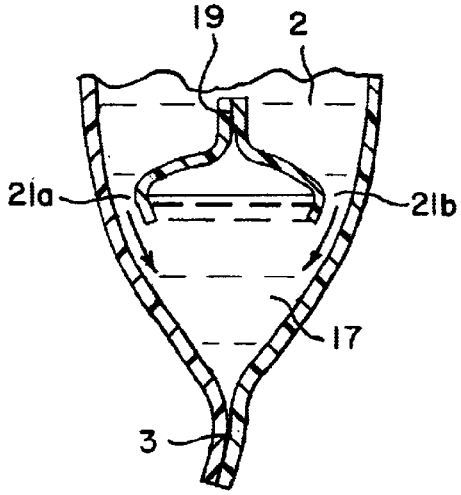
FIG. 27(B) shows the film valve of FIG. 27A installed in a pouch.
Figure 27A:
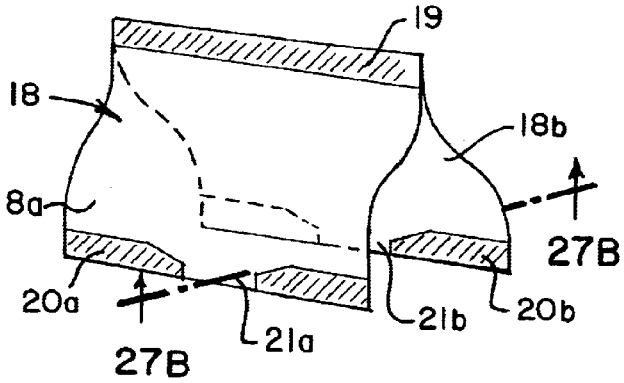
FIG. 27(A) shows a fourth embodiment of the film valve for use in the pouch of the present invention.

Referring to FIGS. 27(A) and 27(B), a forth embodiment of film valve 18 has one end of each of two sheets 18*a* and 18*b* heat sealed together at upper edge 19. The other end of each of two sheets 18*a* and 18*b* are heat sealed to opposite side wall members at respective lower edges 20*a* and 20*b* to form a generally inverse V-shape cross-section (see FIG. 27(B)). Non-sealed parts 21*a* and 21*b*, provided in lower edges 20*a* and 20*b*, communicate pouch body 1 and quantitative cell 17 of branched chamber 2.

Figure 28A:
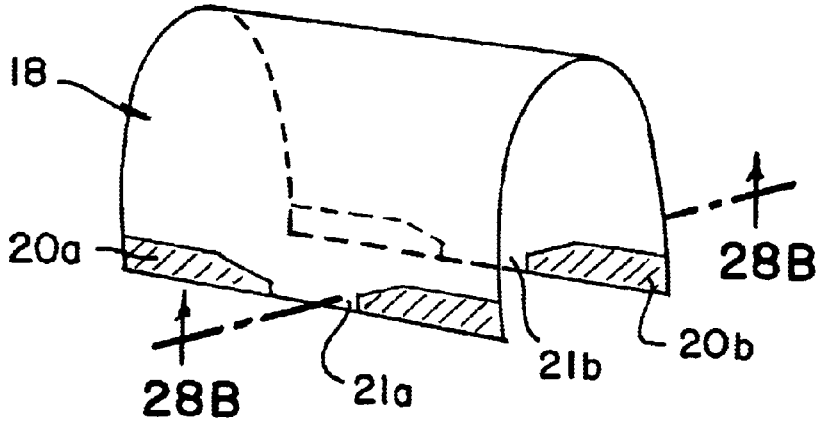
FIG. 28(A) shows a fifth embodiment of the film valve for use in the pouch of the present invention.
Figure 28B:
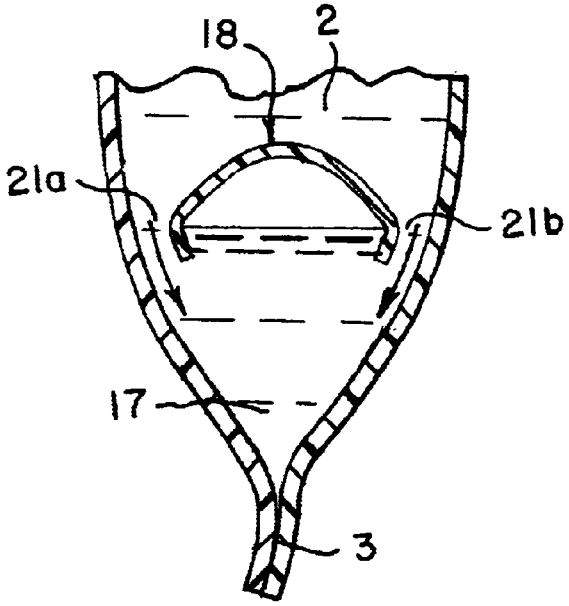
FIG. 28(B) shows the film valve of FIG. 24A installed in a pouch.

Referring to FIGS. 28(A) and 28(B), a fifth embodiment of film valve 18 is formed of one sheet 18 bent to form generally an inverse U-shape cross-section (see FIG. 28(B)). Each of lower edges 20*a* and 20*b* are heat sealed to opposite side wall members of branched chamber 2. Non-sealed parts 21*a* and 21*b*, provided in lower edges 20*a* and 20*b*, communicate pouch body 1 and quantitative cell 17 of branched chamber 2.

EXAMPLE 1

A pouch was made from a multi-layer film obtained by laminating from the outer layer, a 15 μm-thick biaxially oriented nylon film an da 150 μm-thick linear chained low-density polyethylene film using a urethane-based adhesive.

The pouch has the construction as shown in FIG. 2, where a branched chamber diverges from the pouch body. The pouch body had a width of 90 mm, a height of 200 mm, and a width of the perimeter heat seal part of 5 mm. The diverging part was disposed at a position of 35 mm from the top part of the pouch body. The distal end part of the branched chamber assumed a tapered pouring spout. The distal end part of the pouring spout had a width of 20 mm and was positioned 50 mm from the diverging part. The distal end part was tight sealed in a width of 10 mm.

From the top part of the pouch body, 150 ml of a liquid detergent was filled. The top part was then heat sealed. A tab was formed at the distal end part of the pouring spout to facilitate the unsealing of the pouring spout.

The pouring spout of the branched chamber was inserted into an empty bottle having an inside opening diameter of 22 mm. The pouch was inverted to refill the liquid detergent. The refilling was reliably accomplished without any spilling.

EXAMPLE 2

A pouch the same as in Example 1, except that the seal part of the pouring spout of the branched chamber was a readily unsealable seal, was prepared.

The readily unsealable seal member used was a 13 mm-wide three-layer co-extrusion film comprising a 20 μm-thick low-density polyethylene layer having on both sides thereof a blend layer having a thickness of from 7 to 8 μm of low-density polyethylene and polybutene-1 mixed in a weight ration of 80:20.

The branched chamber, folded along the side wall of the pouch body, was raised toward the top part of the pouch body. The pouch was inverted such that the top part of the pouch body was inversely folded along the side wall of the body. The pouring spout of the branched chamber was inserted into the same bottle of Example 1, and the pouch was compressed by a hand. The readily unsealable seal was easily peeled off and the liquid was transferred without spilling.

The unsealing strength of the readily unsealable seal part was measured in the same manner as in the compression test (described later). The average unsealing strength was found to be 23 kgf.

The T peeling strength of the readily unsealable seal member was measured according to JIS Z 0238 and found to be an average of 170 gf/15 mm.

EXAMPLE 3

A pouch was prepared the same as in Example 2, except that a seal part was formed at a position of 10 mm from the diverging part toward the pouring spout of the branched chamber. The seal part was a readily unsealable seal.

EXAMPLE 4

A pouch was prepared the same as in Example 2, except that the diverging part was positioned at the same position as the top part of the pouch body.

EXAMPLE 5

A pouch was prepared the same as in Example 4, except that the distal end of the pouring spout of the branched chamber was fixed to the side wall of the pouch body by a 18 mm-wide mending tape (produced by Sumitomo-3M).

EXAMPLE 6

A pouch was prepared from the same material as in Example 2, except the pouch had a branched chamber as shown in FIG. 20. The seal part was a readily unsealable seal member located 10 mm more toward the diverging point than the distal end of the branched chamber. The pouch body was filled with 150 ml of water. The branched chamber was filled with 5 g of calcium chloride.

The T peel strength of the easy open seal was an average of 170 gf/15 mm. The compression strength of the readily unsealable seal member was measured to be an average of 24 kgf.

EXAMPLE 7

A pouch was prepared the same as Example 6, except that the position of the seal part was 5 mm from the diverging point. The pouch was filled with the same materials as in Example 6.

The T peel strength of the easy open seal was an average of 170 gf/15 mm. The compression strength of the readily unsealable seal member was measured to be an average of 24 kgf.

EXAMPLE 8

A pouch was prepared from the same materials as in Example 1. The pouch had three branched chambers as shown in FIGS. 22 and 23. Each of the seal members were made as tight seals. Water was filled into the pouch body. The branched chambers were filled with instant coffee, sugar, and creme.

Comparative Example 1

A pouch was prepared from the same materials as in Example 1. The pouch body had a width of 90 mm and a height of 245 mm. A branched chamber was not formed in the pouch. The pouch body was shaped to taper from a position of 185 mm above the bottom toward the top part.

At the distal end of the pouch body, a 20 mm-wide pouring spout was formed. The pouring spout was sealed by a readily unsealable seal as described in Example 2. Into the pouch body was placed 150 ml of a liquid detergent. The pouch was sealed and the strength of the readily unsealable seal part was measured to an average of 23 kgf. The T peeling strength was measured to an average of 170 gf/15 mm.

Comparative Example 2

A pouch was prepared the same as in Comparative Example 1, except the pouch upper part was folded, at a position 60 mm from the distal end of the pouch, to lie along the side wall of the pouch body. The distal end of the pouring spout was fixed to the side wall of the pouch be a 18 mm-wide mending tape (produced by Sumitomo-3M).

Comparative Example 3

A pouch was prepared using the same materials as in Example 1. The pouch body was partitioned into 2 compartments by a readily unsealable seal member. The pouch was 90 mm wide and 245 mm high. The width of the seal member was 10 mm. The seal member was 35 mm from the top-of the pouch. The pouch was filled from the top with 150 ml of water. The readily unsealable seal member was then formed. Into the smaller chamber was placed 5 g calcium chloride. The top of the pouch was then tight heat sealed.

Comparative Example 4

A pouch was prepared as in Comparative Example 3, except the pouch was folded at a position 10 mm below the seal member.

Comparative Example 5

A pouch was prepared as in Comparative Example 4, except the end of the folded compartment was secured to the pouch body with mending tape.

Drop Test

Each pouch was fallen 100 times from a height of 120 cm in an atmospheric temperature of 23 C. such that the side wall of the pouch struck on the floor face. The peeled state of the readily unsealable seal member and the ruptured state of the pouch were evaluated by eye.

Fifty pouch were tested of each sample.

The evaluation results are shown in Table 1.

TABLE 1

| | Number of pouches where the readily unsealable seal member was peeled off | Peeled state of readily unsealable seal number |
|---|---|---|
| Example 1 | — | — |
| Example 2 | 0 | no peeling |
| Example 3 | 0 | no peeling |
| Example 4 | 0 | no peeling |
| Example 5 | 0 | no peeling |
| Example 6 | 0 | no peeling |
| Example 7 | 0 | no peeling |
| Example 8 | 0 | no peeling |
| Comp. Example 1 | 50 | complete peeling |
| Comp. Example 2 | 8 | >3 mm peeling |

TABLE 1-continued

| | Number of pouches where the readily unsealable seal member was peeled off | Peeled state of readily unsealable seal number |
|---|---|---|
| Comp. Example 3 | 37 | >5 mm peeling |
| Comp. Example 4 | 34 | >5 mm peeling |
| Comp. Example 5 | 5 | <2 mm peeling |

Compression Test

A pouch was sandwiched between two transparent and smooth acryl plates having a size sufficiently larger than the pouch. The pouches were compressed in an atmospheric temperature of 23 C. at a rate of 50 mm/min. The load at the time when the readily unsealable seal member was peeled off was measured.

The peeling of the readily unsealable seal member was judged by the inflection point appearing on a recorder in addition to visual observation through the acryl plate. If the pouch was ruptured before the readily unsealable seal portion was peeled off, the load at the time of rupture was measured.

Ten pouches were tested for each sample.

The evaluation results are shown in Table 2.

TABLE 2

| | Number of pouches where the readily unsealable seal portion was peeled off |
|---|---|
| Example 1 | — |
| Example 2 | 0 |
| Example 3 | 0 |
| Example 4 | 0 |
| Example 5 | 0 |
| Example 6 | 0 |
| Example 7 | 0 |
| Example 8 | 0 |
| Comp. Example 1 | 10 |
| Comp. Example 2 | 6 |
| Comp. Example 3 | 10 |
| Comp. Example 4 | 10 |
| Comp. Example 5 | 10 |

Evaluation Results—Drop Test

In the pouch of Example 1, a tab for unsealing was formed at the unsealing starting part of the pouring spout of the branched chamber. Nevertheless, no pouch was ruptured in the drop test.

In the pouches of Examples 2–8, the readily unsealable seal member of the pouring spout was not peeled off in any pouch at the drop test. In all pouches of the present invention, the protection of the readily unsealable seal member against a falling shock was excellent.

On the other hand, in the pouch of Comparative Example 1, the readily unsealable seal member was ruptured in all pouches when dropped. In the pouch of Comparative Example 2, the pouch was folded so as to protect the readily unsealable seal member of the pouring spout. Nevertheless, 8 of the pouches ruptured in the drop test. In the pouches of Comparative Examples 3–5, none of the pouches showed the degree of protection of the readily unsealable seal member as compared to the pouches of the present invention. Even in the pouches of the Comparative Examples which did not rupture, there was noted peeling of the readily unsealable seal member in each case.

Evaluation Results—Compression Test

In the pouches of Examples 2–8, the readily unsealable seal member was protected even when a very strong compression load of from 340 to 400 kg was imposed. This strong of a load would rupture the tight heat seal of the pouch before rupturing the protected readily unsealable seal member.

On the other hand, in all the pouches of Comparative Examples 1–5, a load of less than 300 kgf was sufficient to peel off the readily unsealable seal member. In the pouches of Comparative Examples 1 and 3, in which the readily unsealable seal members were not protected by folding, the readily unsealable seal members ruptured at around 24 kgf. Compared to the pouches of the present invention, the protection of the readily unsealable seal member is inferior in conventional pouches.

In the pouches of Examples 1–8, according to the present invention, the blend layer comprising low-density polyethylene and polybutene-1 was used as the readily unsealable seal member at the readily unsealable seal portion of the pouring spout. However, other than this specific composition, any known readily unsealable seal member may be used. For example, a readily unsealable seal member may be an interface peeling type, where the peeling takes place at the heat sealed interface. Moreover, the readily unsealable seal member may be a type using the interlayer peeling in a multi-layer film comprising two of more layers.

The readily unsealable seal member may be one having easy peelability on both surfaces, such as that used in Examples 2–5. The readily unsealable seal member may also be one having easy peelability on only one surface.

In Example 5, the branched chamber was fixed to the side wall of the pouch body with mending tape. Any known fixing means, such as spot seal, double coated tape, hot melting, pressure sensitive adhesive, hooking, clips, and the like, may be used to fix the branched chamber to the side wall of the pouch body.

According to the present invention, a pouch prevented from unintended flowing out of the content, having excellent pouring properties, and having high rupture resistance is described. When the pouch is used for refilling a receiving container, the present invention provides a pouch with excellent refilling properties.

The pouch of the present invention consists of at least two chambers. Accordingly, when the pouch is used for two different contents, such as a medicament and a solution, each chamber can be separately filled. The contents are then mixed at the time of use.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

We claim:

1. A pouch comprising:

a pouch body having a top part and a bottom part; and a branched chamber extending outwardly from a side wall of the pouch body at a location proximal to the top part with respect to the bottom part, the branched chamber having a pouring spout defined at a distal end thereof and an entrance is formed from the pouch body into the branched chamber, the branched chamber having a valve member disposed therein for defining a quantitative cell within the branched chamber, the valve member having a feature that provides selective communication between the pouch body and the quantitative cell so that contents can flow into and be held within the quantitative cell, wherein a first section of the valve member is attached to a first side wall of the branched chamber and a second section of the valve member is attached to a second side wall of the branched chamber.

2. The pouch of claim 1, wherein the valve member comprises a sheet of film having an upper edge and an opposing lower edge.

3. The pouch of claim 2, wherein the upper edge comprises the first section of the valve member that is attached to the first side wall and the lower edge comprises the second section of the valve member that is attached to the second side wall and the feature comprises a flow section in the lower edge which is free of attachment to the second side wall to permit fluid communication between the pouch body and the quantitative cell.

4. The pouch of claim 3, wherein the flow section has on opposite sides thereof two sections of the lower edge and the second side wall.

5. The pouch of claim 3, wherein the upper edge is attached to the first side wall proximate to an entrance from the pouch body into the branched chamber.

6. The pouch of claim 3, wherein the flow section is disposed in approximately a middle section of the lower edge.

7. The pouch of claim 3, wherein the quantitative cell is disposed between the valve member and the pouring spot.

8. The pouch of claim 4, further including:

a rupturable seal extending across the branched chamber between an upper edge of the valve member and the entrance from the pouch body into the branched chamber, the rupturable seal preventing unwanted flow from the pouch body prior to use of the pouch.

9. The pouch of claim 2, wherein the upper edge comprises the first section of the valve member that is attached to the first side wall and the lower edge comprises the second section of the valve member that is attached to the second side wall and the feature comprises an opening formed in the valve member along the lower edge to permit fluid communication between the pouch body and the quantitative cell.

10. The pouch of claim 9, wherein both the lower and upper edges are continuous seals that extend across the branched chamber.

11. The pouch of claim 2, wherein the upper edge comprises the first section of the valve member that is attached to the first side wall and the lower edge comprises the second section of the valve member that is attached to the second side wall and the feature comprises a slit formed in the valve member along or near the lower edge to permit fluid communication between the pouch body and the quantitative cell.

12. The pouch of claim 11, wherein both the lower and upper edges are continuous seals that extend across the branched chamber and the slit is configured to open under force and provide communication between the pouch body and the quantitative cell.

13. The pouch of claim 1, wherein the valve member comprises first and second film sheets that are attached together along lower edges thereof with an upper edge of the first film sheet being attached to a first side wall of the branched chamber and an upper edge of the second film sheet being attached to a second side wall of the branched chamber and wherein the feature comprises a flow section where the two lower edges are free from attachment to permit fluid communication between the pouch body and the quantitative cell.

14. The pouch of claim 13, wherein the quantitative cell is disposed between the sealed lower edges and the pouring spout.

15. The pouch of claim 13, wherein the flow section has on opposite sides thereof two sections of the lower edges that are sealed to one another.

16. The pouch of claim 1, wherein the valve member comprises first and second film sheets that are attached together along upper edges thereof with a lower edge of the first film sheet being attached to a first side wall of the branched chamber and a lower edge of the second film sheet being attached to a second side wall of the branched chamber and wherein the feature comprises a flow section formed in each lower edge where the lower edge is free from attachment to one of the first and second side walls to permit fluid communication between the pouch body and the quantitative cell.

17. The pouch of claim 16, wherein each flow section is formed in approximately a middle section of one lower edge.

18. The pouch of claim 16, wherein the flow sections of the two lower edges are arranged opposite one another.

19. The pouch of claim 16, wherein each flow section defines a flow pathway defined between a length of the lower edge that is free of attachment and the corresponding side wall that faces the lower edge.

20. The pouch of claim 1, wherein the valve member comprises a folded film sheet that has a first edge attached to a first side wall of the branched chamber and a second edge attached to a second side wall of the branched chamber and wherein the feature comprises a flow section formed in each of the first and second edges where the lower edge is free from attachment to one of the first and second side walls to permit fluid communication between the pouch body and the quantitative cell.

21. The pouch of claim 20, wherein the folded film sheet has an inverse U-shape cross-section.

22. The pouch of claim 20, wherein the flow sections of the first and second edges are arranged opposite one another.

23. The pouch of claim 20, wherein each flow section defines a flow pathway defined between a length of one of the first and second edges that is free of attachment and the corresponding side wall that faces the edge.

24. The pouch of claim 23, wherein the quantitative cell is disposed between the attached lower edges and the pouring spout.

25. A pouch comprising:

a pouch body having a first end and a second end; and a branched chamber extending outwardly from a side wall of the pouch body at a location proximal to the first end of the pouch body with an entrance being formed from the pouch body into the branched chamber, the branched chamber having a pouring spout defined at a distal end thereof, the branched chamber having a valve member disposed therein for defining a quantitative cell within the branched chamber, the valve member being arranged so that selective communication is provided between the pouch body and the quantitative cell such that contents can flow from the pouch body into the quantitative cell where they are held therein, wherein a first section of the valve member is attached to a first side wall of the branched chamber and a second section of the valve member is attached to a second side wall of the branched chamber.

26. The pouch of claim 25, wherein the quantitative cell holds a predetermined amount of contents that represent a measured dosage that is dispensed by applying a force to the quantitative cell causing the measured dosage to be discharged from the pouring spout and whereupon said discharge, the quantitative cell can receive additional contents from the pouch body to provide an additional measured dosage.

* * * * *